US005725069A

United States Patent [19]

Sullivan

[11] Patent Number: 5,725,069

[45] Date of Patent: Mar. 10, 1998

[54] EXTENDABLE PYRAMID LADDER SYSTEM

[76] Inventor: Tom Sullivan, 618 E. 17th St., Munhall, Pa. 15120

[21] Appl. No.: 718,005

[22] Filed: Sep. 13, 1996

[51] Int. Cl.[6] ..... E06C 1/54

[52] U.S. Cl. ..... 182/157; 182/33; 182/132; 248/277.1

[58] Field of Search ..... 182/157, 33, 132, 182/141; 248/277.1, 211, 202; 52/67; 187/269; 74/521

[56] References Cited

U.S. PATENT DOCUMENTS 385,874 7/1888 Parks ..... 182/157

*Primary Examiner*—Leslie A. Braun
*Assistant Examiner*—Long Dinh Phan

[57] ABSTRACT

A new Extendable Pyramid Ladder System for providing a compact stable ladder system which allows the user to access heightened areas by standing on a broad platform while simultaneously providing maximum stability, and for providing compact storage by folding into a swaged shape. The inventive device includes a vertical series of planar support members aligned parallel to one another, a left scissors bracket pivotally secured to the bottom portion of said planar support members, a right scissors bracket secured to the bottom portion of said planar support member opposite of the left scissors bracket where said scissors brackets allow the series of planar support members to extend vertically upward, a recessed handle on the cornice of the top planar support member, and a securing means to retain a swaged shape for the invention when in the storage position. The series of planar support members fit within each other to form a swaged shape for storage. The user may leave the desired number of upper planar support members in the storage position to provide a broad swaged platform for the user to stand upon to reach heightened areas.

9 Claims, 3 Drawing Sheets

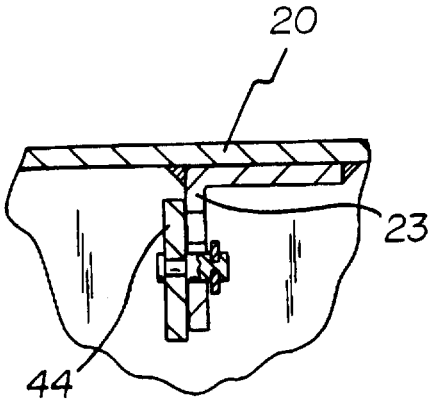
FIG. 5
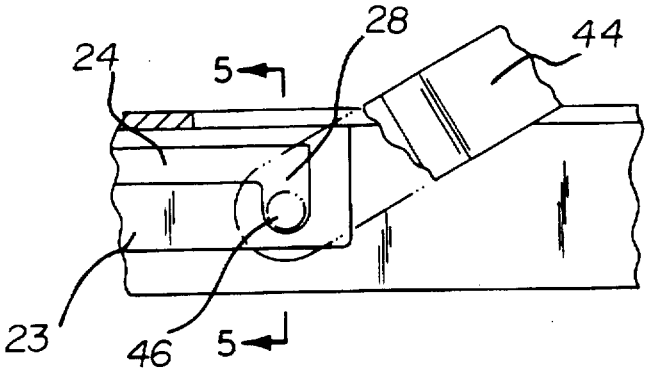
FIG. 6
FIG. 7
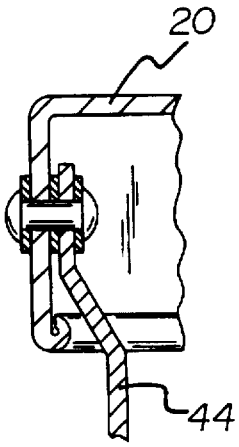

EXTENDABLE PYRAMID LADDER SYSTEM

BACKGROUND OF THE INVENTION

1. Field of the Invention

The present invention relates to Ladder Devices and more particularly pertains to a new Extendable Pyramid Ladder System for providing a compact stable ladder system which allows the user to access heightened areas by standing on a broad platform while simultaneously providing maximum stability, and for providing compact storage by folding into a swaged shape.

2. Description of the Prior Art

The use of Ladder Devices is known in the prior art. More specifically, Ladder Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Ladder Devices include U.S. Pat. No. 5,211,260; U.S. Pat. No. 4,989,692; U.S. Design Pat. No. 267,817; U.S. Pat. No. 5,370,204; U.S. Pat. No. 4,630,819 and U.S. Pat. No. 5,022,491.

While these devices fulfill their respective, particular objectives and requirements, the aforementioned patents do not disclose a new Extendable Pyramid Ladder System. The inventive device includes a vertical series of planar support members aligned parallel to one another, a left scissors bracket pivotally secured to the bottom portion of said planar support members, a right scissors bracket secured to the bottom portion of said planar support member opposite of the left scissors bracket where said scissors brackets allow the series of planar support members to extend vertically upward, a recessed handle on the cornice of the top planar support member, and a securing means to retain a swaged shape for the invention when in the storage position.

In these respects, the Extendable Pyramid Ladder System according to the present invention substantially departs from the conventional concepts and designs of the prior art, and in so doing provides an apparatus primarily developed for the purpose of providing a compact stable ladder system which allows the user to access heightened areas by standing on a broad platform while simultaneously providing maximum stability, and for providing compact storage by folding into a swaged shape.

SUMMARY OF THE INVENTION

In view of the foregoing disadvantages inherent in the known types of Ladder Devices now present in the prior art, the present invention provides a new Extendable Pyramid Ladder System construction wherein the same can be utilized for providing a compact stable ladder system which allows the user to access heightened areas by standing on a broad platform while simultaneously providing maximum stability, and for providing compact storage by folding into a swaged shape, The general purpose of the present invention, which will be described subsequently in greater detail, is to provide a new Extendable Pyramid Ladder System apparatus and method which has many of the advantages of the Ladder Devices mentioned heretofore and many novel features that result in a new Extendable Pyramid Ladder System which is not anticipated, rendered obvious, suggested, or even implied by any of the prior art Ladder Devices, either alone or in any combination thereof.

To attain this, the present invention generally comprises a vertical series of planar support members aligned parallel to one another, a left scissors bracket pivotally secured to the bottom portion of said planar support members, a right scissors bracket secured to the bottom portion of said planar support member opposite of the left scissors bracket where said scissors brackets allow the series of planar support members to extend vertically upward, a recessed handle on the cornice of the top planar support member, and a securing means to retain a swaged shape for the invention when in the storage position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Extendable Pyramid Ladder System apparatus and method which has many of the advantages of the Ladder Devices mentioned heretofore and many novel features that result in a new Extendable Pyramid Ladder System which is not anticipated, rendered obvious, suggested, or even implied by any of the prior art Ladder Devices, either alone or in any combination thereof.

It is another object of the present invention to provide a new Extendable Pyramid Ladder System which may be easily and efficiently manufactured and marketed.

It is a further object of the present invention to provide a new Extendable Pyramid Ladder System which is of a durable and reliable construction.

An even further object of the present invention is to provide a new Extendable Pyramid Ladder System which is susceptible of a low cost of manufacture with regard to both materials and labor, and which accordingly is then susceptible of low prices of sale to the consuming public, thereby making such Extendable Pyramid Ladder System economically available to the buying public.

Still yet another object of the present invention is to provide a new Extendable Pyramid Ladder System which provides in the apparatuses and methods of the prior art some of the advantages thereof, while simultaneously overcoming some of the disadvantages normally associated therewith.

Still another object of the present invention is to provide a new Extendable Pyramid Ladder System for providing a compact stable ladder system which allows the user to access heightened areas by standing on a broad platform while simultaneously providing maximum stability, and for providing compact storage by folding into a swaged shape.

Yet another object of the present invention is to provide a new Extendable Pyramid Ladder System which includes a vertical series of planar support members aligned parallel to one another, a left scissors bracket pivotally secured to the bottom portion of said planar support members, a right scissors bracket secured to the bottom portion of said planar support member opposite of the left scissors bracket where said scissors brackets allow the series of planar support members to extend vertically upward, a recessed handle on the cornice of the top planar support member, and a securing means to retain a swaged shape for the invention when in the storage position.

Still yet another object of the present invention is to provide a new Extendable Pyramid Ladder System that is extremely mobile and convenient to store.

Even still another object of the present invention is to provide a new Extendable Pyramid Ladder System that is pyramid shaped providing maximum stability, sturdiness, and durability.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 4 disclosing the second right member slidably engaging the right L-shaped bracket.

FIG. 6 is a magnified view from FIG. 4 displaying a side view of the second right member slidably engaging the right L-shaped bracket and captured within the right locking notch.

FIG. 7 is a sectional view taken along line 7—7 of FIG. 4.

DESCRIPTION OF THE PREFERRED EMBODIMENT

Figure 1:
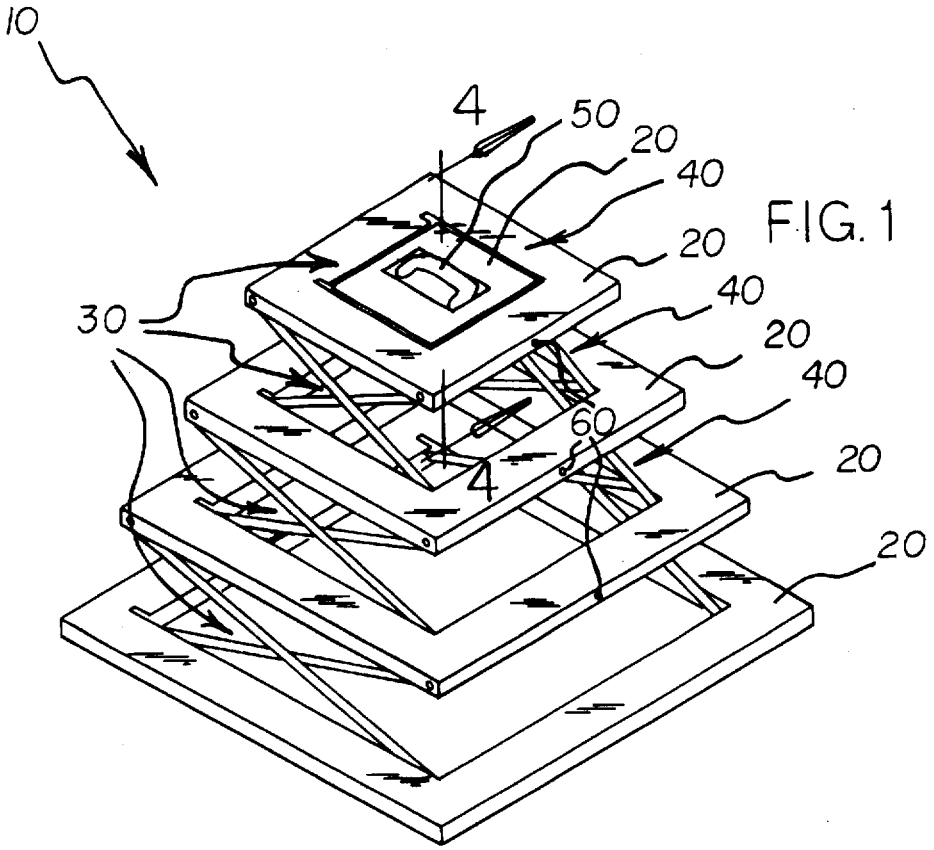
FIG. 1 is a left side perspective view of a new Extendable Pyramid Ladder System in the extended position according to the present invention.
Figure 2:
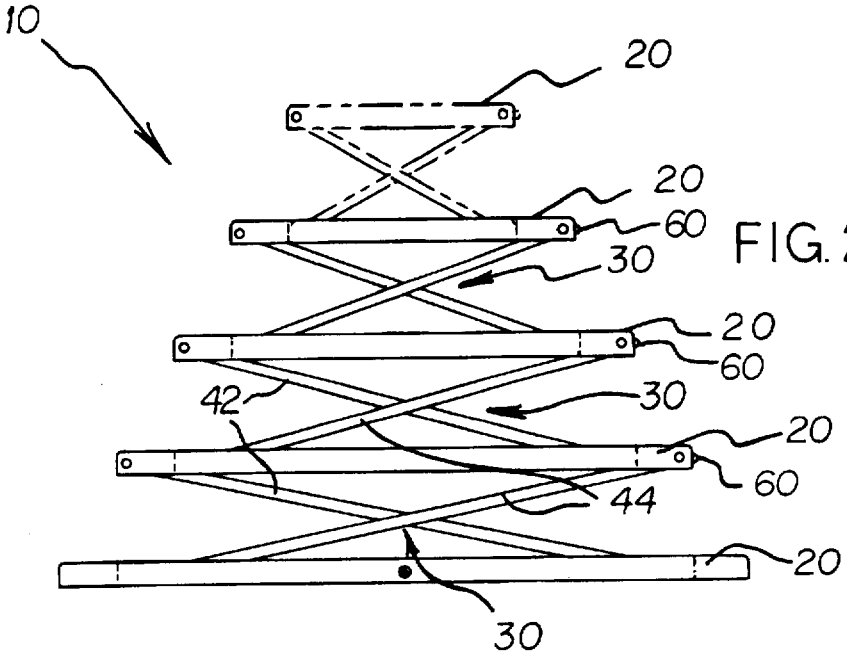
FIG. 2 is a side view thereof.

With reference now to the drawings, and in particular to FIGS. 1 through 7 thereof, a new Extendable Pyramid Ladder System embodying the principles and concepts of the present invention and generally designated by the reference numeral 10 will be described.

More specifically, it will be noted that the Extendable Pyramid Ladder System 10 comprises a vertical series of planar support members 20 aligned parallel to one another with the top planar support member 20 having the smallest surface area and where the lower planar support members 20 gradually increase in surface area thereby forming a substantially pyramid shaped structure, a left scissors bracket 30 pivotally secured mesial each layer between the planar support members 20, and a right scissors bracket 40 pivotally secured mesial each layer between the planar support members 20 opposite of the left scissors.

Figure 3:
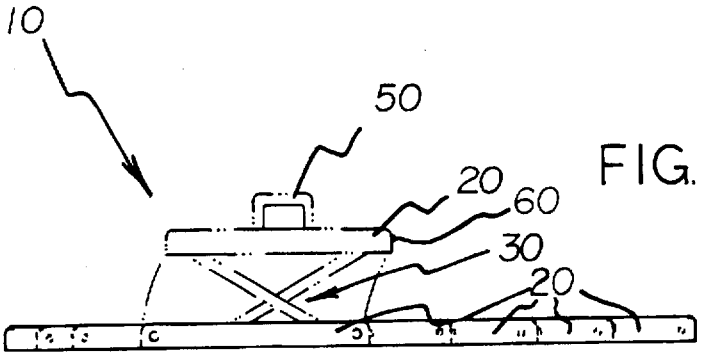
FIG. 3 is an exploded isometric illustration of the present invention.
Figure 4:
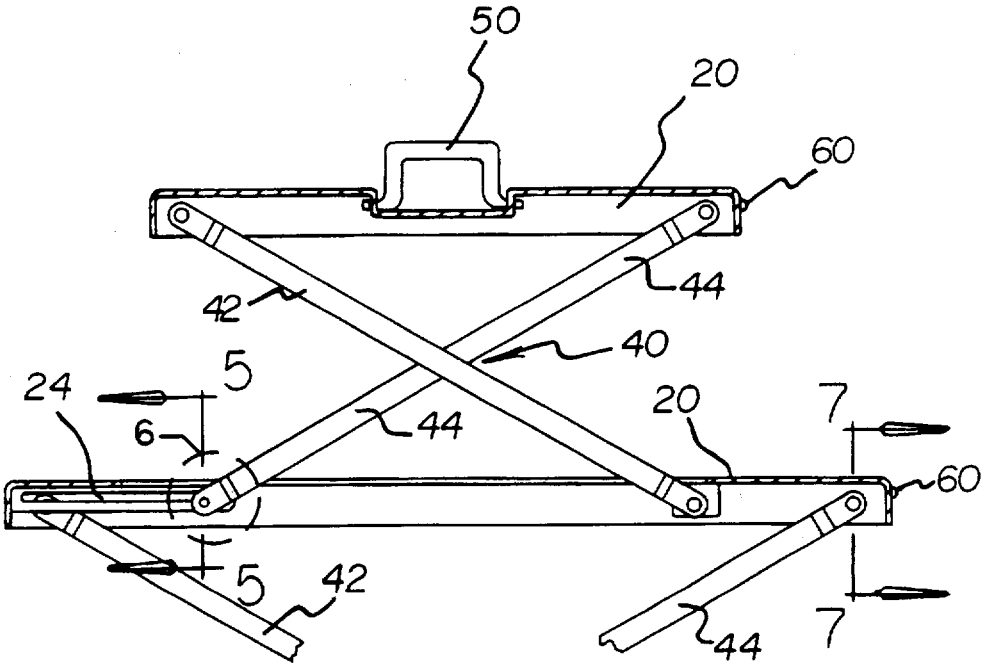
FIG. 4 is a cross sectional view taken along line 4—4 of FIG. 1 disclosing the right scissors bracket.

As best illustrated in FIG. 5 of the drawings, it can be shown that the planar support members 20 has a right L-shaped bracket 23 secured to the bottom surface of each planar support member 20. The right L-shaped bracket 23 has a right slot 24 and a right locking notch 28. The right L-shaped bracket 23 slidably retains the right scissors bracket 40 within the right slot 24. An unnumbered left L-shaped bracket has an unnumbered left slot and an unnumbered left locking notch secured to the bottom surface of each planar support member 20 opposite of the right L-shaped bracket 23, and slidably retaining the left scissors bracket 30 within the unnumbered left slot. The left scissors bracket 30 has a first left member 32 pivotally secured at one end to the bottom surface of the upper planar support member 20 projecting and slidably engaging the unnumbered left slot and unnumbered left locking notch through a sliding pin secured orthogonally to the first left member 32, and a second left member 34 pivotally secured at one end to the cornice of a lower planar support member projecting and pivotally engaging the bottom surface of the upper planar support member 20 opposite of the pivoting point of the first left member 32 thereby forming an X-shape with said first left member 32. The right scissors bracket 40 includes a first right member 42 pivotally secured at one end to the bottom surface of an upper planar support member projecting and slidably engaging the right slot 24 and right locking notch 28 through a sliding pin 46 secured orthogonally to the first right member 42 as shown in FIGS. 4–7. A second right member 44 is pivotally secured at one end to the cornice of a lower planar support member 20 projecting and pivotally engaging the bottom surface of the upper planar support member 20 opposite of the pivoting point of the first right member 42 thereby forming an X-shape with said first right member 42. The left and right scissors brackets 30, 40 for an integral support structure allowing the series of planar support members 20 to be contracted together forming a substantially planar shape for storage of the present invention. The top planar support member 20 includes a recessed handle 50 on the cornice as best shown in FIGS. 1 and 3 of the drawings. As shown in FIGS. 1 through 4 of the drawings, a detent pin 60 is secured to the side of each planar support member 20 which engages the edge of the square aperture of the lower planar support member 20. When the series of planar support members 20 are in the storage position, the detent pins 60 secure the invention in swaged shape for convenient storage of the invention. The planar support members 20 are preferably square shaped as shown in the drawings. The square shaped planar support members 20 preferably include an unnumbered centrally positioned square aperture providing a lightweight structure for mobility. The planar support members 20 are preferably constructed from a non-corrosive metal.

In use, the user removes the recessed handle 50 from the recess in the top planar support member 20 as shown in FIG.

3 of the drawings. The user then vertically pulls the recessed handle 50, thereby lifting the top planar support member 20 until the left and right scissors brackets 30, 40 are extended forming the X-shape. The user continues to lift upward again extending the next level of planar support members 20. The user continues lifting until every level of the series of planar support members 20 has been extended to the present invention's maximum height. The user then releases the lifting force thereby allowing the sliding pins 46 to lock into the unnumbered left locking notch and the right locking notch 28 preventing the left and right scissors brackets 30, 40 from contracting. The user then lowers the desired number of the upper planar support members 20 to form the broad swaged working platform which the user can walk on to perform various tasks such as painting heightened areas without worrying about tipping the invention over as in a conventional ladder. When finished, the user lifts the recessed handle 50 allowing the sliding pins 46 to retract from the locking notches and to slidably project into the unnumbered left slot and right slot 24. The user then allows the present invention to descend into the storage position where the detent pins 60 secured to the edge of the planar support members 20 engage the edges of the lower planar support members 20 which prevents the present invention from expanding into the extended position. The invention when in the storage position forms a swaged shape, as shown in FIG. 3, which can be conveniently stored in almost any area within a house or apartment where space is of the essence.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An extendable pyramid ladder system comprising:

a vertical series of planar support members having decreasing surface area and being aligned parallel to one another with the top planar support member having the smallest surface area and where the support members gradually increase in surface area from said top planar support thereby forming a substantially pyramid shaped structure when expanded and said planar members being substantially co-planar when in the storage position;

a left scissors bracket pivotally secured to and positioned between the planar support members; and a right scissors bracket pivotally secured to and positioned between the planar support members opposite of the left scissors whereby each upper planar support member is adapted to line within an opening of its corresponding lower planar support member when in the storage position.

2. The extendable pyramid latter system of claim 1, wherein the planar support members includes:

a right L-shaped bracket including a right slot and a right locking notch secured to the bottom surface of each planar support member, and slidably retaining the right scissors bracket within the right slot; and a left L-shaped bracket including a left slot and a left locking notch secured to the bottom surface of each planar support member opposite of the right L-shaped bracket, and slidably retaining the left scissors bracket within the left slot.

3. The extendable pyramid ladder system of claim 2, wherein the left scissors bracket includes a first left member pivotally secured at one end to the bottom surface of an upper planar support member projecting and slidably engaging the left slot and left locking notch through a sliding pin secured orthogonally to the first left member, and a second left member pivotally secured at one end to the cornice of a lower planar support member projecting and pivotally engaging the bottom surface of the upper planar support member opposite of the pivoting point of the first left member thereby forming an X-shape with said left member.

4. The extendable pyramid ladder system of claim 3, wherein the right scissors bracket includes a first right member pivotally secured at one end to the bottom surface of the upper planar support member projecting and slidably engaging the right slot and right locking notch through a sliding pin secured orthogonally to the first right member, and a second right member pivotally secured at one end to the cornice of the lower planar support member projecting and pivotally engaging the bottom surface of the upper planar support member opposite of the pivoting point of the first right member thereby forming an X-shape with said right member, forming an integral support structure with the left scissors bracket allowing the series of planar support members to be contracted together forming a substantially planar shape.

5. The extendable pyramid ladder system of claim 4, wherein the top planar support member includes a recessed handle on the cornice.

6. The extendable pyramid ladder system of claim 5, wherein the series of planar support member include a detent pin secured concentrically on a corresponding side, where the detent pin engages the edge of the lower planar support member when the series of planar support members are in the co-planar storage position.

7. The extendable pyramid ladder system of claim 6, wherein the planar support members are square shaped.

8. The extendable pyramid ladder system of claim 7, wherein the square shaped planar support members below the top square planar support member include a centrally positioned square aperture which receives the above smaller planar support member, whereby the series of planar support members may be lowered within one another in the co-planar storage position.

9. The extendable pyramid ladder system of claim 8, wherein the planar support members are constructed from a non-corrosive metal.

* * * * *